US012016367B2

(12) United States Patent
Besso et al.

(10) Patent No.: US 12,016,367 B2
(45) Date of Patent: Jun. 25, 2024

(54) CONSUMABLE PRODUCT FOR AN AEROSOL GENERATING DEVICE AND METHODS OF FILLING AND MANUFACTURING A CONSUMABLE PRODUCT FOR AN AEROSOL GENERATING DEVICE

(71) Applicant: PHILIP MORRIS PRODUCTS S.A., Neuchatel (CH)

(72) Inventors: Clement Besso, Neuchatel (CH); Yves Jordil, Lausanne (CH); Dorothy Tritz, Yverdon-les-Bains (CH); Rui Nuno Batista, Morges (CH); Nazan Gunduz, Le Mont sur Lausanne (CH); Joanne Venouil, Geneva (CH)

(73) Assignee: Philip Morris Products S.A., Neuchatel (CH)

( * ) Notice: Subject to any disclaimer, the term of this patent is extended or adjusted under 35 U.S.C. 154(b) by 698 days.

(21) Appl. No.: 17/267,878

(22) PCT Filed: Aug. 19, 2019

(86) PCT No.: PCT/EP2019/072103
§ 371 (c)(1),
(2) Date: Feb. 11, 2021

(87) PCT Pub. No.: WO2020/038868
PCT Pub. Date: Feb. 27, 2020

(65) Prior Publication Data

US 2021/0161195 A1 Jun. 3, 2021

(30) Foreign Application Priority Data

Aug. 21, 2018 (EP) ..... 18190093

(51) Int. Cl.
*A24B 15/16* (2020.01)
*A24D 1/14* (2006.01)
*A24D 1/20* (2020.01)

(52) U.S. Cl.
CPC ..... *A24B 15/165* (2013.01); *A24D 1/14* (2013.01); *A24D 1/20* (2020.01)

(58) Field of Classification Search
None
See application file for complete search history.

(56) References Cited

U.S. PATENT DOCUMENTS 8,308,388 B2 11/2012 Guay
2015/0258288 A1* 9/2015 Sullivan ..... A24F 40/485 128/203.12

FOREIGN PATENT DOCUMENTS

ES 2 089 938 10/1996
GB 1 108 995 4/1968
(Continued)

OTHER PUBLICATIONS

Search Report and Written Opinion for PCT/EP2019/072103 dated Oct. 21, 2019 (9 pages).
(Continued)

*Primary Examiner* — Philip Y Louie
*Assistant Examiner* — Madeleine P Delacruz
(74) *Attorney, Agent, or Firm* — Mueting Raasch Group

(57) ABSTRACT

A consumable product for use in an aerosol generating device is disclosed, the consumable product comprising a foam matrix (302); and a packaging element housing the foam matrix; wherein the packaging element is configured to hold the foam matrix in a first, compressed, configuration prior to use of the consumable product in an aerosol generating device, the packaging element having a first sacrificial seal, wherein upon opening the first sacrificial seal the
(Continued)

packaging element holds the foam matrix in a second, less compressed, configuration.

16 Claims, 8 Drawing Sheets

(56) References Cited

FOREIGN PATENT DOCUMENTS

| | | | | | |
|---|---|---|---|---|---|
| RU | 2469629 | | 12/2012 | | |
| WO | WO-2017001352 | A2 * | 1/2017 | ..... | A24F 40/42 |
| WO | WO 2017/202597 | | 11/2017 | | |
| WO | WO 2018/002084 | | 1/2018 | | |
| WO | WO 2018/122375 | | 7/2018 | | |

OTHER PUBLICATIONS

Extended European Search Report for Application No. 18190093.7 dated Feb. 1, 2019 (11 pages).
Office Action issued in Russia for Application No. 2021102250 dated Dec. 21, 2022 (8 pages). English translation included.

* cited by examiner

CONSUMABLE PRODUCT FOR AN AEROSOL GENERATING DEVICE AND METHODS OF FILLING AND MANUFACTURING A CONSUMABLE PRODUCT FOR AN AEROSOL GENERATING DEVICE

This application is a U.S. National Stage Application of International Application No. PCT/EP2019/072103 filed Aug. 19, 2019, which was published in English on Feb. 27, 2020 as International Publication No. WO 2020/038868 A1. International Application No. PCT/EP2019/072103 claims priority to European Application No. 18190093.7 filed Aug. 21, 2018.

The present invention relates to a consumable product for use in an aerosol generating device and methods of filling and manufacturing a consumable product for an aerosol generating device. In particular, the present invention relates to a consumable product including a foam matrix.

A number of devices for generating an aerosol have been proposed in the art. For example, devices for generating aerosols which heat rather than combust an aerosol-forming substrate have been proposed. Heated smoking devices in which tobacco is heated rather than combusted, are one type of such device. An aim of such smoking devices is to reduce the generation of unwanted and harmful smoke constituents as produced by the combustion and pyrolytic degradation of tobacco in conventional cigarettes. These heated smoking devices are commonly known as 'heat not burn' devices.

Heated smoking devices of the above-described type commonly comprise a heating chamber, provided with, or defined by, heating surfaces, into which an article for forming an aerosol is inserted, prior to use. The article typically contains an aerosol-forming substrate which is heated by a heating element of the device to generate an aerosol. The aerosol is entrained in air drawn through the aerosol-generating article to the user. When the aerosol-forming substrate contained in an article has been exhausted the article can be replaced. The heated smoking device thereby constitutes a reusable device whilst the article comprises a 'consumable' product.

Known consumables typically include a porous structure that can be impregnated with different aerosol-generating materials (for example, powders, liquids or gels including flavours, nicotine, glycerine etc), which produce aerosols when heated. Such consumables can encounter issues. For example, the porous structure of the consumable results in a high volume, which can make the consumable bulky (especially when provided in a pack including multiple consumables). In addition, some aerosol generating materials may be subject to oxidation within the porous structure, which limits the lifespan of the aerosol generating material. Similarly, when using multiple aerosol generating materials within a single consumable, unwanted/premature reaction between the materials may limit their lifespan.

According to a first aspect of the invention, there is provided a consumable product for use in an aerosol generating device, the consumable product comprising:

a foam matrix; and a packaging element housing the foam matrix;

wherein the packaging element is configured to hold the foam matrix in a first, compressed, configuration prior to use of the consumable product in an aerosol generating device;

the packaging element having a first sacrificial seal, wherein upon opening the first sacrificial seal the packaging element holds the foam matrix in a second, less compressed, configuration.

Aptly, the packaging element has a second sacrificial seal.

Aptly, the first and second sacrificial seals are in fluid communication.

Aptly, the foam matrix in at least the second, less compressed, configuration enables fluid to pass through it.

Aptly, in the first, compressed, configuration the foam matrix is partially vacuumed within the packaging element.

Aptly, at least the first sacrificial seal is in communication with a reservoir of aerosol generating medium.

Aptly, at least the first sacrificial seal is configured to fit a corresponding port or opening of the reservoir of an aerosol generating medium.

Aptly, the reservoir of aerosol generating medium is separate from the packaging element of the consumable prior to use.

Aptly, the reservoir of aerosol generating medium is housed within the packaging element.

According to a second aspect of the invention, there is provided a method of filling an aerosol generating consumable for use in an aerosol generating device comprising, compressing and packaging a foam matrix wherein the packaging element has at least one sacrificial seal;

coupling the at least one sacrificial seal to a reservoir of aerosol generating medium; and releasing the compressed state of the foam matrix such that this assists in ingestion of the aerosol generating medium from the reservoir.

According to an aspect of the invention there is a method of filling an aerosol consumable for use in an aerosol generating device comprising, a compressed and packaged foam matrix wherein the packaging element has at least one sacrificial seal; the method comprising:

coupling the at least one sacrificial seal to a reservoir of an aerosol generating medium; and releasing the compressed state of the foam matrix such that this assists in ingestion of the aerosol generating medium from the reservoir.

Ideally releasing the compressed state of the foam matrix is due to breaking the sacrificial seal such that the sacrificial seal is opened. Ideally an opening of the desired reservoir would be located adjacent to the sacrificial seal at the time of breaking the sacrificial seal.

Advantageously when the compressed state is released the lower inside pressure of the packaging element will assist in the ingestion of material or fluid through the sacrificial seal now opened, and into the foam matrix. This advantageously allows a very quick filling of the foam matrix and even distribution throughout the foam matrix. Ideally an opening to an appropriate reservoir will be located at the opened sacrificial seal thus the desired content of the reservoir will be ingested into the foam matrix.

Aptly, compressing the foam matrix comprises partial vacuum compressing. Or in that the compressed foam had been compressed due to partial vacuum.

According to a third aspect of the invention, there is provided a method of manufacturing an aerosol generating consumable product for use in an aerosol generating device, the method comprising:

providing a foam matrix and a packaging element;

housing the foam matrix in a first, compressed, configuration within the packaging element;

the packaging element having a first sacrificial seal, wherein upon opening the first sacrificial seal, the packaging element holds the foam matrix in a second, less compressed, configuration.

Also according to the present invention, there is provided a method of manufacturing an aerosol generating consumable product for use in an aerosol generating device, the method comprising: providing a foam matrix and a packaging element; housing the foam matrix in a first, compressed, configuration within the packaging element; the packaging element having a first sacrificial seal, wherein upon opening the first sacrificial seal, the packaging element holds the foam matrix in a second, less compressed, configuration, wherein the foam matrix in at least the second, less compressed configuration enables fluid to pass through the foam matrix.

The method of manufacturing an aerosol generating consumable may further comprise wherein at least the first sacrificial seal is in communication with a reservoir of aerosol generating medium.

The method of manufacturing an aerosol generating consumable may further comprise wherein the packaging element has a second sacrificial seal.

According to a fourth aspect of the invention, there is provided an aerosol generating device for use in generating an aerosol comprising a consumable product as claimed in the first aspect of the invention.

Aptly, the consumable is subjected to heat in use.

Aptly, the at least two sacrificial seals allow fluid communication to a mouthpiece end of the aerosol generating device.

According to a fifth aspect of the invention there is provided a consumable product for use in a smoking article, the consumable product comprising:

a foam matrix;

at least one medium for generating an aerosol within the foam matrix; and a packaging element housing the foam matrix and the at least one medium, wherein the packaging element is configured to hold the foam matrix in a compressed configuration prior to use of the consumable product in a smoking article.

According to an aspect of the invention there is provided a consumable product for use in a smoking article, the consumable product comprising;

a foam matrix;

a packaging element housing the foam matrix, wherein the packaging element is configured to hold the foam matrix in a compressed configuration prior to use of the consumable product in a smoking article; and a sacrificial seal, configured to break and allow the ingestion of a medium for generating an aerosol.

Aptly the consumable product will have the sacrificial seal broken just prior to use in a smoking article, or aerosol generating device. In embodiments where the medium is stored separately from the consumable product, appropriately the reservoir comprising the medium will be located near to the sacrificial seal when the sacrificial seal is broken, and the medium will be ingested into the foam matrix. As explained previously, this is advantageous to aid a quick filling of the foam matrix and even distribution, as well as prolonging shelf life.

In embodiments where the medium reservoir is within the consumable product, the sacrificial seal may still be broken for example by physically tearing or compressing the sacrificial seal prior to use, or even heating the sacrificial seal prior to use, then placing the consumable within the smoking article or in an aerosol generating device.

The invention also covers embodiments where the consumable product is placed in either the smoking article or in the aerosol generating device and then the sacrificial seal is broken by any means, for example physical compression, tearing, cutting or by heating, for example heat may melt the sacrificial seal and open it, or the heat may cause a pressure build up in the packaging element to break the sacrificial seal. Thus, the medium, when in a separate location can enter into the foam matrix, or if already in the foam matrix the medium will have space to move and create an aerosol.

Aptly, in a second configuration the packaging element is configured to release the foam matrix from the compressed configuration to an operational configuration prior to or during use of the consumable product in a smoking article, wherein in the operational configuration the foam matrix is less compressed than in the compressed configuration.

Aptly, in the second configuration, the packaging element defines a path for flow of at least one medium for generating an aerosol into the foam matrix.

Aptly, the packaging element is sealed by at least one seal, wherein the packaging element is configured such that the foam matrix is released from the compressed configuration to the operational configuration by breaking the at least one seal to allow expansion of the foam matrix.

Aptly, the packaging element comprises at least one detachable portion, wherein the at least one seal is broken by removing the at least one detachable portion.

Aptly, in the compressed configuration the foam matrix is sealed within the packaging element.

Aptly, the packaging element further comprises a covering portion configured to compress the packaging element against the foam matrix and thereby compress the foam matrix.

Aptly, the packaging element is configured such that the foam matrix is released from the compressed configuration upon removal of the covering portion of the packaging element from the consumable product.

Aptly, the foam matrix is impregnated with at least one medium for generating an aerosol within the foam matrix.

Aptly, the consumable product comprises at least one reservoir coupled to or adjacent to the foam matrix, wherein at least one medium for generating an aerosol within the foam matrix is housed within the at least one reservoir.

Aptly, in the operational configuration, the foam matrix is configured to at least partially draw the at least one medium from the at least one reservoir into the foam matrix.

Aptly, the consumable product further comprises a sacrificial seal separating the reservoir and the foam matrix, wherein upon rupture of the sacrificial seal the reservoir is fluidly coupled to the foam matrix.

According to a sixth aspect of the invention there is provided a method of assembling a consumable product for use in a smoking article, the method comprising:

providing a consumable product for a smoking article comprising:

a foam matrix;

at least one medium for generating an aerosol within the foam matrix; and a packaging element;

housing the foam matrix in a compressed configuration within the packaging element; and housing the at least one medium within the packaging element.

According to a seventh aspect of the present invention there is provided a consumable product for use in a smoking article, the consumable product comprising:

a foam matrix;

a packaging element housing the foam matrix, wherein in a first configuration the packaging element holds the foam matrix in a compressed configuration prior to use of the consumable product in a smoking article;

wherein in a second configuration the packaging element allows the foam matrix to expand from the compressed configuration prior to or during use of the consumable product in a smoking article;

wherein in the second configuration, the packaging element defines a path for flow of at least one medium for generating an aerosol into the foam matrix.

Certain embodiments provide the advantage that a consumable product is provided that is more compact than known consumables, thus easier to store or transport.

Certain embodiments provide the advantage that a consumable product is provided with an improved lifespan compared to known consumables.

As used herein, the term "foam matrix" is used to describe a matrix comprising a suitable foam material for use within an aerosol generating device, for example a reticulated open-cell foam. During use of the aerosol generating device, the foam matrix may allow air to pass therethrough during draw by a user. The foam matrix may be made of any suitable material, for example natural vegetal fibers (for example, tobacco or wood fibers) or other sorts of fibers, for example, metallic fibers or polyurethane.

As used herein, the term "filling" is used to describe partial filling, or filling to any degree. The term "filling" does not need to be complete filling.

As used herein, the term "compressed configuration" is used to describe a configuration for a foam matrix, in which the foam matrix is compressed beyond a reference configuration. The pore networks of the foam matrix are at least partially closed in the compressed configuration to prevent ingress of a medium for generating an aerosol. The compressed configuration will also include a configuration in which the foam matrix is at a pressure below the external pressure, for example below atmospheric pressure. This may be achieved by the use of a vacuum, or partial vacuum means.

As used herein, the term "operational configuration" is used to describe a configuration for a foam matrix, in which the foam matrix is operational. That is, for example the foam matrix is suitable for use within an aerosol generating device. In the operational configuration the pore networks of the foam matrix are at least partially open to allow ingress of a medium for generating an aerosol. An "operational configuration" will ideally be a non-compressed configuration. That is, when housed in a packaging element, the foam matrix may be in an operational configuration when the inside of the packaging element is open to the atmosphere and not withstanding draw and use by the user. In such a configuration the inside of the packaging element may have an equal pressure to the atmospheric pressure outside.

As used herein, the term "medium for generating an aerosol" is used to describe a substance (in either solid, liquid or gel form) that is suitable for generating an aerosol upon heating. Aptly the medium has an active ingredient. Aptly the active ingredient is aerosol generating. Aptly the active ingredient is nicotine (whether in liquid or powder form or other), tobacco, flavor compounds or pharmaceutical compounds.

As used herein, the term "holds" or "to hold" can mean at least partially support, at least partially cover, at least partially surround or retain. In one state this may be due to separating the pressure of an internal atmosphere to the pressure of an external atmosphere.

As used herein, the term "reservoir" is used to describe a vessel for housing one or more media for generating an aerosol. The reservoir may be made from any suitable material. For example, the reservoir may be made from plastic, metal, glass. Preferably the reservoir will contain a medium which is liquid, gel or powder which is easily able to be taken up into the foam matrix.

As used herein, the term "packaging element" is used to describe an element for housing (or packaging) a foam matrix and optionally a reservoir of a substance for generating an aerosol. Typically, this will be a fluid impermeable housing, for example, a plastic.

As used herein, the term 'aerosol' is used to describe a suspension of relatively small particles in a fluid medium.

As used herein, the term 'sacrificial seal' is used to describe an opening that is irreversibly brought from a closed configuration to an open configuration. The sacrificial seal may be configured between sealed layers of the packaging element, such that separation of the layers leads to opening of the sacrificial seal. The sacrificial seal may be configured in a flow path through the packaging element. In such a case, the sacrificial seal may be opened upon removal of a portion of the packaging element, for example, a seal or a detachable portion. That is, the sacrificial seal may be defined by the seal or detachable portion. The sacrificial seal may be broken by tearing or other physical means. Alternatively, or in addition, the sacrificial seal may be broken by the heating of the seal, the foam matrix or the entire aerosol generating consumable such that the increased pressure breaks the sacrificial seal or a chemical reaction, for example, melting, breaks the sacrificial seal.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Embodiments of the invention will now be described, by way of example only, with reference to the accompanying drawings, in which:

FIG. 1*a* illustrates a top cut-away view of a first example of a consumable product for use in an aerosol generating device;

FIGS. 1*b* and 1*c* illustrate side cut-away views of the consumable product shown in FIG. 1*a*, before and after assembly respectively;

FIG. 2 illustrates a top cut-away view of another example of a consumable product;

FIGS. 3*a* and 3*b* illustrate top and side cut-away views respectively of another example of a consumable product;

FIGS. 4*a* and 4*b* illustrate top and side cut-away views respectively of another example of a consumable product;

Figure 1A:
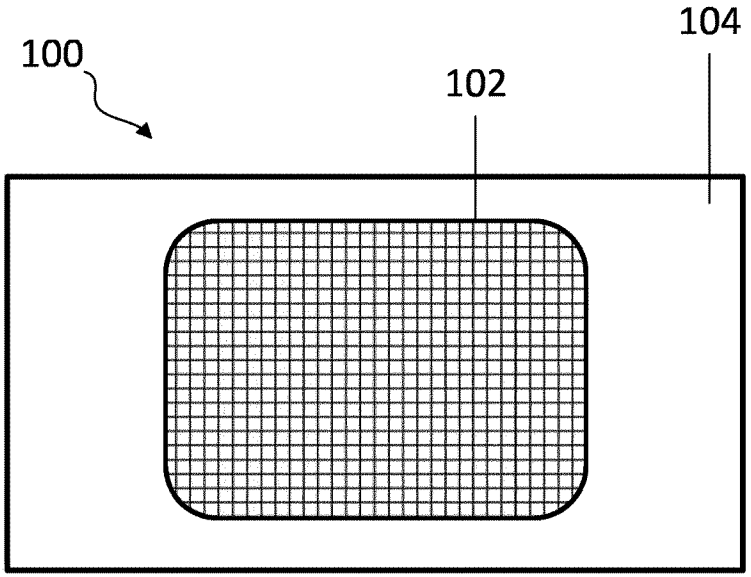
Figure 1B:
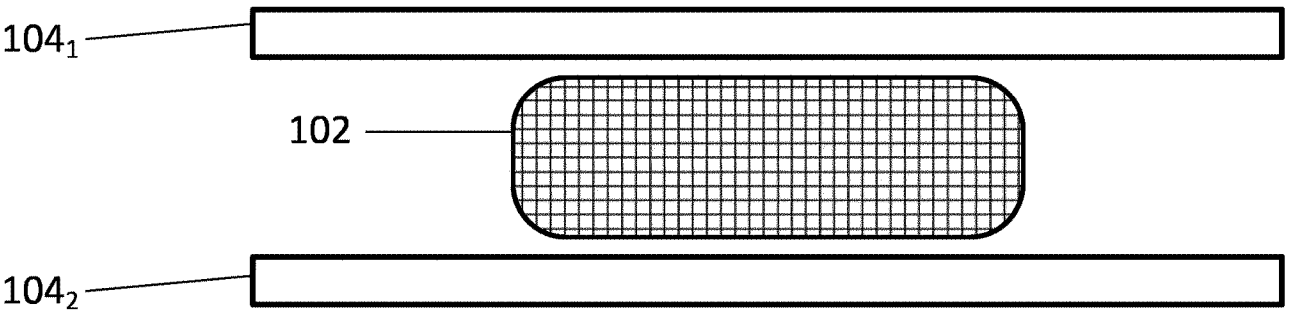
Figure 1C:
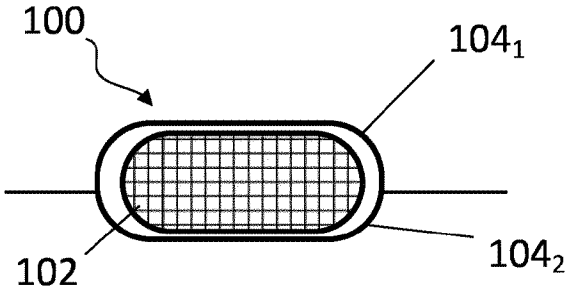

FIGS. 1*a*, 1*b* and 1*c* illustrate a first example of a consumable product 100 for use in an aerosol generating device. The consumable product 100 includes a foam matrix 102. The foam matrix is a reticulated open-cell foam. In this example the foam matrix 102 is made of natural vegetal fibers (for example tobacco or wood fibers). Alternatively, the foam matrix 102 may be any suitable foam material. For example, the foam matrix 102 may be made from other sorts of fibers, for example, metallic fibers or polyurethane.

In this example, the consumable product 100 includes at least one medium for generating an aerosol within the foam matrix 102. The foam matrix 102 is impregnated with the at least one medium. That is, the foam matrix 102 is pre-impregnated into the porous structure of the foam matrix 102 prior to assembly of the consumable product. In this example, the at least one medium is at least one of a liquid, a gel or a powder that generates an aerosol once heated. In other words, there may be a single medium or a combination of media impregnated into the foam matrix 102. Examples of such media include nicotine, tobacco, non-tobacco volatile flavour compounds, pharmaceutical active compounds, and glycerine.

The consumable product 100 includes a packaging element 104. In this example, the packaging element 104 includes two layers $\mathbf{104}_{1,2}$. During assembly (in other words, prior to use of the consumable product in an aerosol generating device), the foam matrix 102 is housed within the packaging element 104. In this example, the foam matrix 102 is housed between the two layers of the packaging element 104. The packaging element 104 is then evacuated or pressurised to a pressure below atmospheric pressure. That is, the area of the packaging element 104, in which the foam matrix 102 is housed (in other words between the two layers $\mathbf{104}_{1,2}$) is evacuated or partially vacuumed to a pressure below the surrounding atmosphere.

The packaging element may be made from any suitable material, for example hard or soft plastics or metal. In this example, the layers of the packaging element each comprises a polyurethane film.

In evacuating or reducing the pressure between the layers $\mathbf{104}_{1,2}$ of the packaging element 104, the packaging element 104 is brought to a first configuration, where, the foam matrix 102 is held in a compressed configuration by the packaging element 104. That is, the pressure differential between the atmosphere and the evacuated space within the packaging element 104, acts to compress the foam matrix 102.

When in the compressed configuration, the pore networks of the foam matrix 102 may be at least partially closed. As a result, the exposure of the internal pore network to air is reduced. Air may be drawn into the foam but encounters a very high Resistance to Draw (RTD). As such, the exposure of the impregnated medium within the foam matrix 102 to air is reduced. Therefore, the rate of oxidation of the medium is also reduced.

Once the foam matrix 102 is in the compressed configuration the foam matrix 102 is sealed within the packaging element 104. In this example, the packaging element is sealed by heat-sealing or adhering the layers together around the foam matrix 102 (as shown in FIGS. 1*b* and 1*c*). In some examples the layers of the packaging element 104 may be heat-sealed or adhered partially around the perimeter of the foam matrix 102 prior to evacuation or pressurisation of the foam matrix 102.

By sealing the foam matrix 102 within the packaging element 104, the pressure differential between the atmosphere and the space between the layers $\mathbf{104}_{1,2}$ (housing the foam matrix 102) is retained, such that the foam matrix 102 continues to be held in the compressed configuration by the packaging element 104.

The packaging element 104 has a second configuration prior to use of the consumable product 100 in an aerosol generating device. In the second configuration the packaging element 104 is configured to release the foam matrix 102 from the compressed configuration to a second, operational, configuration. In the operational configuration the foam matrix 102 is less compressed than in the compressed configuration. That is, in the operational configuration the pore networks of the foam matrix 102 are more open relative to the compressed configuration and hence enables fluid to pass through it. In the operational configuration the opened pore networks also allow allows increased air-flow therethrough. As such, in the operational configuration air may be drawn into/through the foam without a high RTD due to the open porous structure.

In this example, the packaging element 104 is configured such that the foam matrix 102 is released from the compressed configuration to the operational configuration by opening a sacrificial seal of the packaging element. In this example the sacrificial seal of the packaging element is opened by breaking a portion of the heat-seal between the layers of the packaging element. That is, the sacrificial seal is defined by the heat-seal between the layers of the packaging element.

Breaking the seal around the foam matrix 102 removes the pressure differential between the interior of the packaging element 104 (in other words between the layers $\mathbf{104}_{1,2}$) and the atmosphere. This allows expansion of the foam matrix 102. In this example, the foam matrix 102 is then removed from between the layers $\mathbf{104}_{1,2}$ to allow insertion of the foam matrix 102 into an aerosol generating device.

The foam matrix 102 is biased to the operational configuration, such that when the pressure differential is removed, the foam matrix 102 expands to the operational configuration and hence is no longer held in a compressed configuration. In some examples, at least one of the layers $\mathbf{104}_{1,2}$ may include a tab or a detachable portion to assist a user in separating the layers $\mathbf{104}_{1,2}$ (and hence opening the sacrificial seal).

Prior to use, the foam matrix 102 is inserted, in its operational configuration, into an aerosol generating device (specifically a heat-not-burn smoking device), including a heating element. During operation, the consumable product is subject to heat. That is, the foam matrix 102 is heated by the heating element of the aerosol generating device, typically upon activation by the user. As the foam matrix 102 is heated, the medium impregnated within the foam matrix 102 generates an aerosol. A user draws air into the aerosol generating device. The air passes through the foam matrix 102 (in other words the air passes through the porous structure of the foam matrix 102). The aerosol is entrained with the air as it passes through the foam matrix 102, such that an air/aerosol mixture is delivered to the user from the aerosol generating device.

Figure 2:
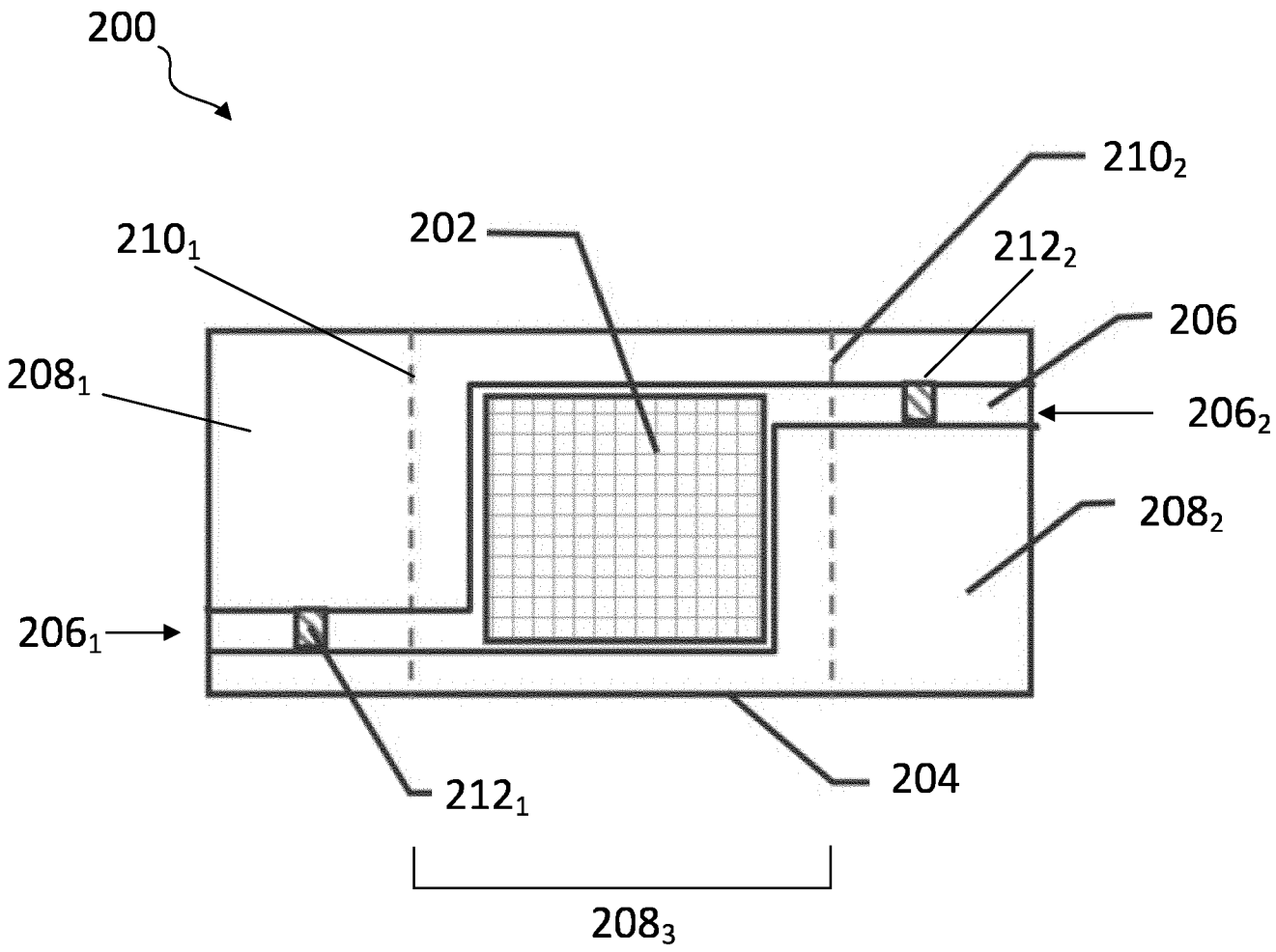

FIG. 2 illustrates another example of a consumable product 200 for use in an aerosol generating device. Corresponding features to consumable product 100 are noted with the corresponding label with the prefix 2- and will not be described again. In this example, the packaging element 204 defines a path 206 for flow of fluid therethrough. The path for flow 206 extends from a first side of the packaging element 204 to a second opposing side of the packaging element 204. That is, the path for flow 206 includes an inlet $\mathbf{206}_1$ at a first side of the packaging element and an outlet $\mathbf{206}_2$ at a second side of the packaging element 204. The foam matrix 202 (impregnated with at least one medium as per the previously described example) is housed within the path for flow 206.

In this example, the foam matrix 202 is held within the packaging element 204 in the compressed configuration in the same manner as described for the consumable product 100. That is, the foam matrix 202 is located within packaging element 204, before being evacuated/pressurised to below atmospheric pressure. In this example, once the foam matrix 202 is in the compressed configuration the foam matrix 202 is sealed within the packaging element 204 by seals $\mathbf{212}_{1,2}$. The seals may be made from any suitable material, for example paper, foil or plastic.

In this example, the packaging element 204 is configured such that the foam matrix 202 is released from the compressed configuration to the operational configuration by breaking the seals $\mathbf{212}_{1,2}$ to allow expansion of the foam matrix 202. That is, the seals define first and second sacrificial seals respectively, such that breaking the seals corresponds to the opening of first and second sacrificial seals. The seals may be broken in any suitable manner, for example by piercing or by detaching the seal from the packaging element (for example by pulling or twisting the seal).

The first and second sacrificial seals (defined by the seals) are in fluid communication via the flow path 206. Breaking the seals $\mathbf{212}_{1,2}$ removes the pressure differential between the interior of the packaging element 204 (in other words the flow path) and the atmosphere. As such, the foam matrix 202 is no longer held in a compressed configuration.

In this example, the packaging element 204 comprises detachable portions $\mathbf{208}_{1,2}$. The detachable portions $\mathbf{208}_{1,2}$ are coupled to a body portion $\mathbf{208}_3$ of the packaging element 204 via weak portions $\mathbf{210}_{1,2}$. In this example, the weak portions $\mathbf{210}_{1,2}$ include perforations, to provide a local decrease in strength and resistance to tearing. As such, the detachable portions $\mathbf{212}_{1,2}$ can each be removed by a user by tearing or pulling the detachable portions $\mathbf{212}_{1,2}$ relative to the body portion $\mathbf{208}_3$. The detachable portions $\mathbf{208}_{1,2}$ are located at opposing sides of the packaging element 204. Specifically, the detachable portions $\mathbf{208}_{1,2}$ are located at the sides of the packaging element 204, including the inlet $\mathbf{206}_1$ and outlet $\mathbf{206}_2$ of the flow path, respectively. The detachable portions $\mathbf{208}_{1,2}$ include the section of the flow path 206 in which the seals $\mathbf{212}_{1,2}$ are situated. In this example, the seals $\mathbf{212}_{1,2}$ are broken (and hence the foam is allowed to expand to its operational configuration) by removing detachable portions $\mathbf{208}_{1,2}$. That is, the path for flow 206 is opened (or unsealed) upon removal of the detachable portions $\mathbf{208}_{1,2}$.

In use, the consumable product 200 (with the detachable portions $\mathbf{208}_{1,2}$ removed and the foam matrix 202 in the operation configuration) is inserted into the aerosol generating device. The sacrificial seals (seals $\mathbf{212}_{1,2}$) allow fluid communication to a mouthpiece end of the aerosol generating device.

In operation, the foam matrix 202 is heated by the heating element of the aerosol generating device. As the foam matrix 202 is heated, the medium impregnated within the foam matrix 202 generates an aerosol. A user draws air through the aerosol generating device. The air passes through the inlet $\mathbf{206}_1$ of the flow path 206, before travelling through the flow path 206 to the outlet $\mathbf{206}_2$ thereof. As the air passes through the flow path 206, the air passes through the foam matrix 202 (in other words the air passes through the porous structure of the foam matrix 202). The air entrains the aerosol as it passes through the foam matrix 202, such that the air/aerosol mixture flows through the flow path 206 and is delivered to the user via the outlet $\mathbf{206}_2$.

Figure 3A:
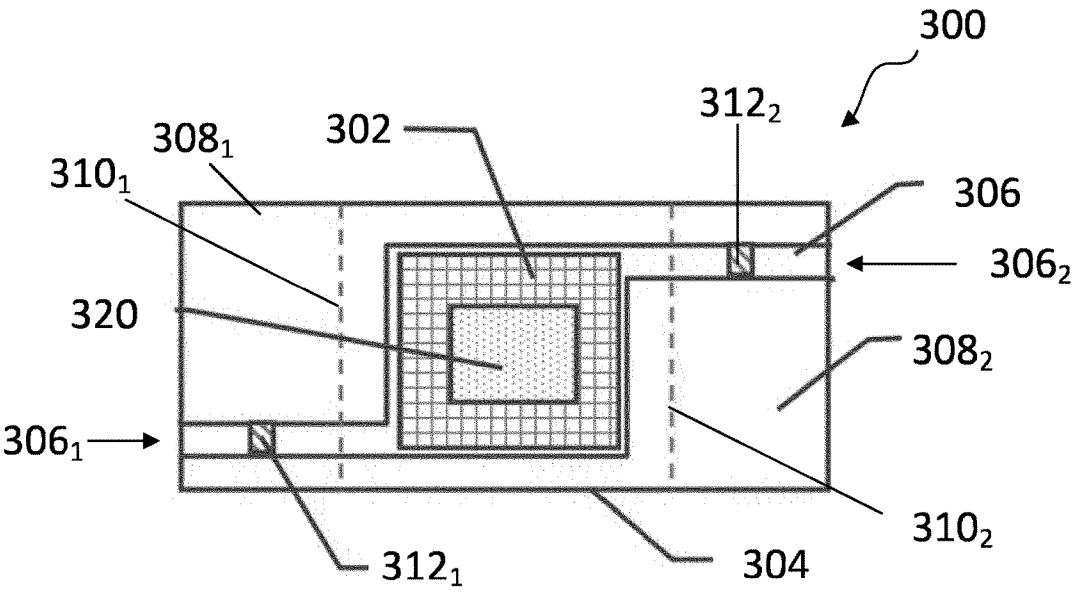
Figure 3B:
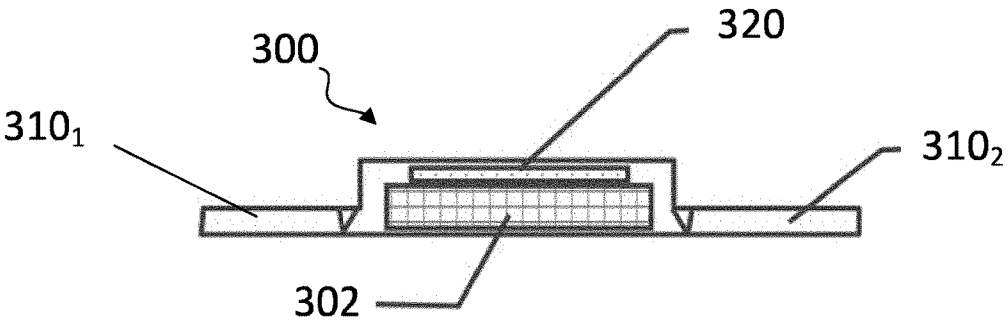

FIGS. 3*a* and 3*b* illustrate another example of a consumable product 300 for use in an aerosol generating device. Consumable product 300 has corresponding features to consumable product 200, with corresponding features labelled with the prefix 3-. In this example, the consumable product 300 includes a reservoir 320 coupled to the foam matrix 302. In this example, the medium (or the one or more media) for generating an aerosol within the foam matrix 302 is housed within the reservoir 320. In this example, the reservoir 320 is housed within the packaging element. The reservoir 320 is located adjacent to the foam matrix 302. The reservoir 320 is fluidly coupled to the foam matrix 302, such that the medium within the reservoir 320 is fluidly coupled to the foam matrix 202. The reservoir may be made from any suitable material. For example, the reservoir may be made from plastic, metal, glass.

In this example, the foam matrix 302 is 'vacuum packed' (in other words compressed by partial vacuum) and subsequently sealed in the same manner as described for the consumable product 200. When the foam matrix 302 is in the compressed configuration, the at least partial closure of the pores within the foam matrix 302 prevents substantial ingress of the medium from the reservoir 320 into the foam matrix 302. That is, in the compressed configuration liquid, powder or gel, in general, cannot be drawn into the foam by capillary action. This ensures that the medium does not leave the reservoir 320 until required and, as such, the exposure to the environment is reduced.

The foam matrix 302 of the consumable product 300 is brought into the operational configuration in the same manner as described for the consumable product 200. In the operational configuration, the foam matrix 302 is configured to at least partially draw the medium from the reservoir 320 into the foam matrix 302. That is, as the foam matrix is released from the compressed configuration and begins to expand, the medium is drawn from the reservoir 320 to the foam matrix 302. In other words, releasing the compressed state of the foam matrix assists in ingestion of the medium into the foam matrix 302 from the reservoir.

The drawing of the medium into the foam matrix 302 from the reservoir 320 is driven by the pressure differential therebetween or by capillary action within the pore network of the foam matrix 302 (or a combination thereof).

Figure 4A:
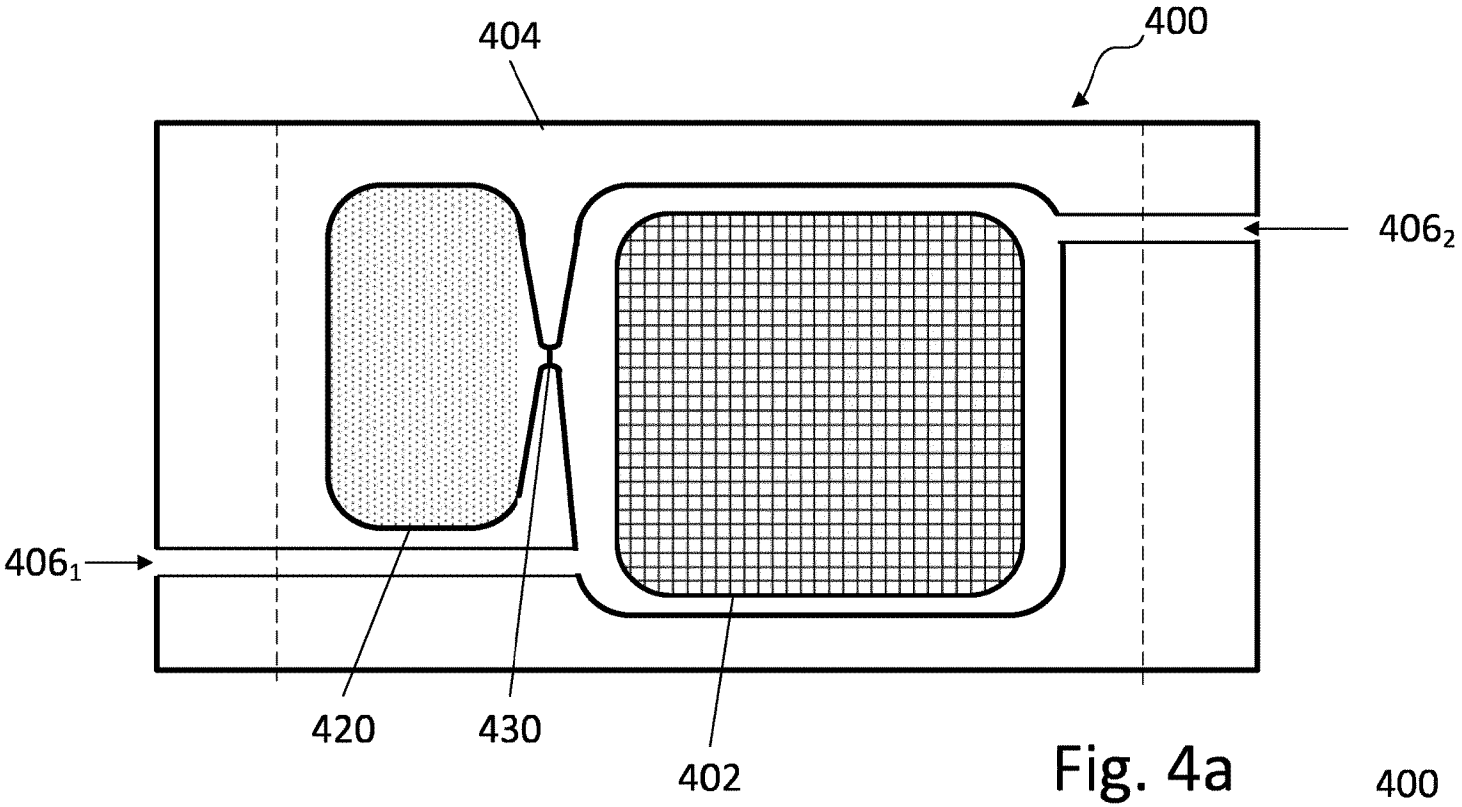
Figure 4B:
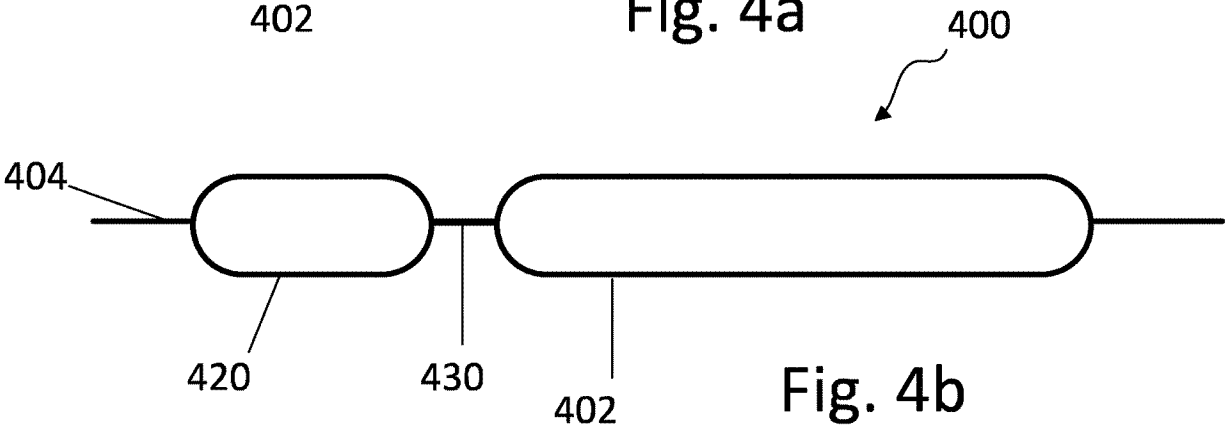

FIGS. 4*a* and 4*b* illustrate another example of a consumable product 400 for use in an aerosol generating device. Consumable product 400 has corresponding features to consumable product 300, with corresponding features labelled with the prefix 4-. In this example, the foam matrix 402 and the reservoir 420 are separated by a sacrificial seal 430. The sacrificial seal 430 helps ensure the medium and the foam matrix 402 are kept separate until the consumable product 400 is required for use. The sacrificial seal may be made from any suitable material, for example paper, foil or plastic. In some examples, the sacrificial seal is a membrane extending across a channel or opening in the packaging element.

Prior to use of the consumable product 400, the sacrificial seal 430 is ruptured by a user, for example by applying a pressure above a defined threshold. In other words, the user may squeeze the consumable product in the region of the reservoir 420 to cause the rupture of the sacrificial seal 430. Upon rupture of the sacrificial seal 430 the reservoir becomes fluidly coupled to the foam matrix 402.

Once the reservoir 420 is fluidly coupled to the foam matrix 402, and the foam matrix 402 is in the operational configuration, the medium is drawn from the reservoir 420 to the foam matrix 402 by the pressure differential therebetween or by capillary action within the pore network of the foam matrix 402. The sacrificial seal 430 may be broken before or after the foam matrix 402 is expanded from the compressed configuration to the operational configuration. The consumable product 400 functions within an aerosol generating device in the same manner as described for the consumable product 300.

Figure 5:
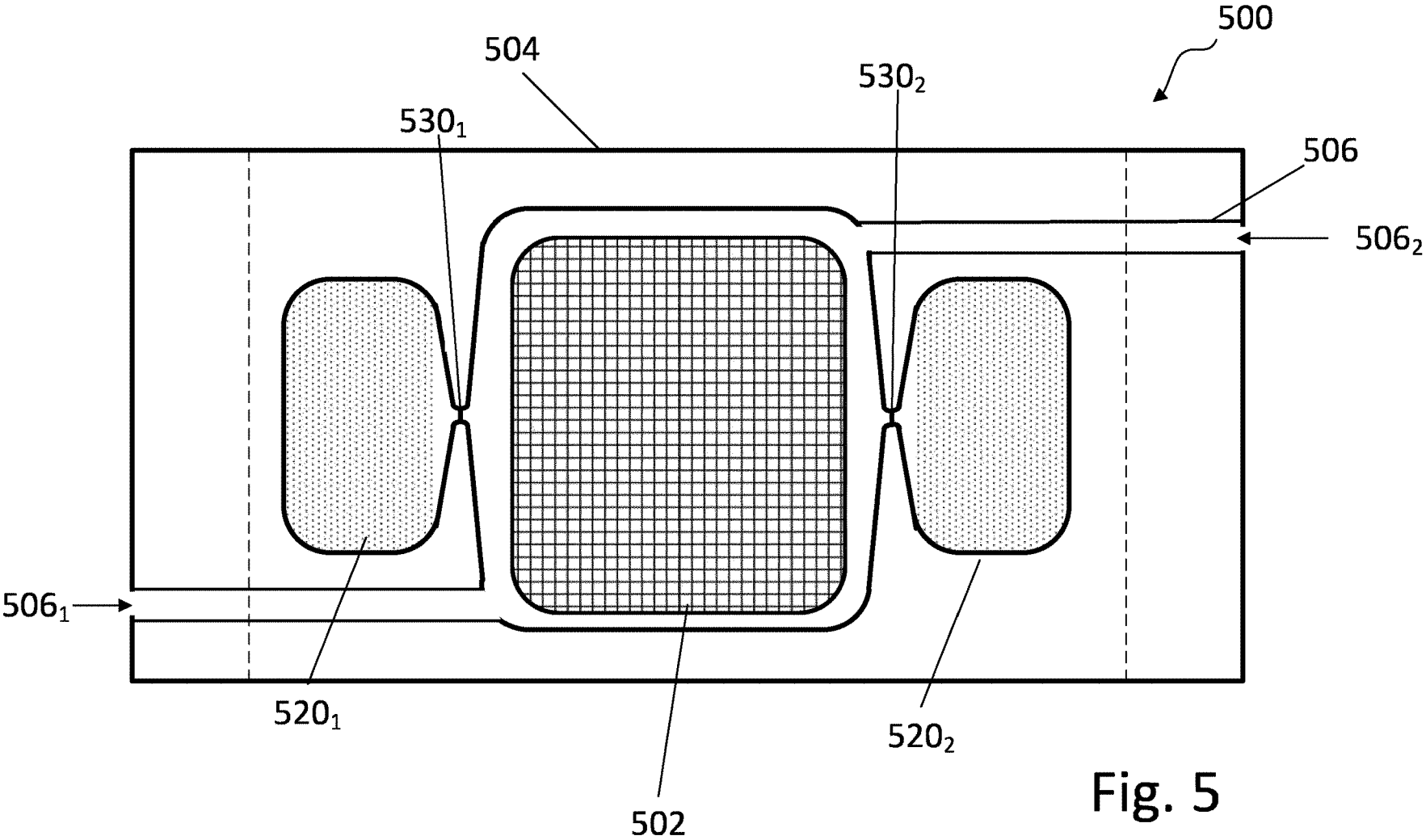
FIG. 5 illustrates a top cut-away view of another example of a consumable product.

FIG. 5 illustrates another example of a consumable product 500 for use in an aerosol generating device. Consumable product 500 has corresponding features to consumable product 400, with corresponding features labelled with the prefix 5-. Such features will not be described again. In this example, the consumable product 500 includes two reservoirs $\mathbf{520}_{1,2}$ coupled to the foam matrix 502. Both reservoirs $\mathbf{520}_{1,2}$ are coupled to the foam matrix in the same manner as described for the consumable product 400, that is, via sacrificial seals $\mathbf{530}_{1,2}$. The medium in the reservoirs may include the same medium (or one or more media) or a different medium (or one or more media).

Figure 6:
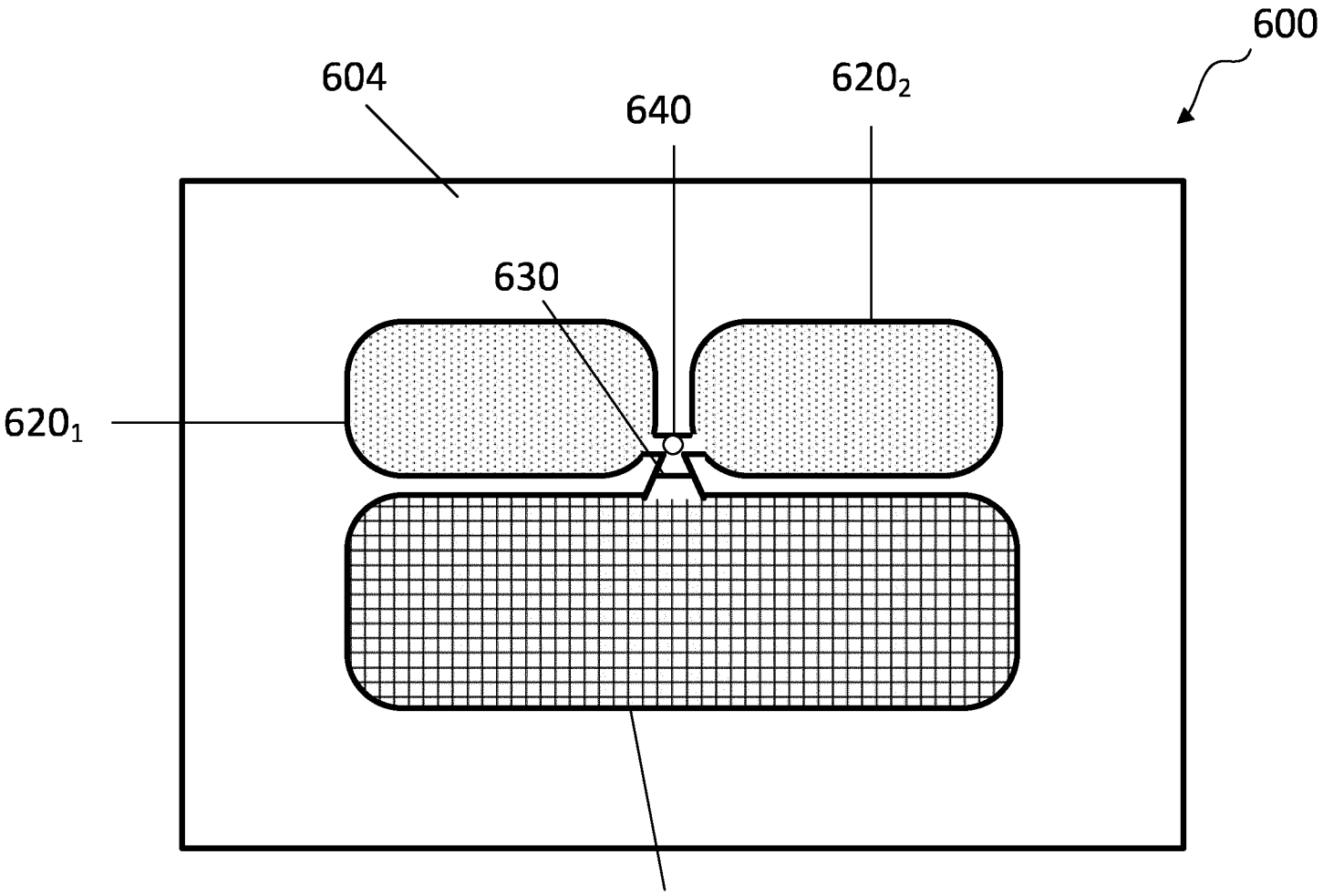
FIG. 6 illustrates a top cut-away view of another example of a consumable product.

FIG. 6 illustrates another example of a consumable product 600 for use in an aerosol generating device. The consumable product 600 has corresponding features to previously described consumable products 100 to 500, with corresponding features labelled with the prefix 6-. In this example, the consumable product 600 includes first and second reservoirs $\mathbf{620}_{1,2}$ coupled to the foam matrix 602, where the first and second reservoirs $\mathbf{620}_{1,2}$ each house at least one medium.

In this example, the consumable product 600 includes a reservoir sacrificial seal 640 fluidly separating the first and second reservoirs $\mathbf{620}_{1,2}$. Upon rupture of the reservoir sacrificial seal 640, for example by applying a pressure above a defined threshold, the first and second reservoirs $\mathbf{620}_{1,2}$ are fluidly coupled. Following rupture of the sacrificial seal 640, the contents of one of the first and second reservoirs $\mathbf{620}_{1,2}$ may enter the adjacent reservoir to mix the contents thereof.

In this example, the consumable product 600 further includes an optional sacrificial seal 630, which separates the reservoirs $\mathbf{620}_{1,2}$ from the foam matrix. That is, following rupture of sacrificial seal 640, the contents of the reservoirs are prevented from contacting the foam matrix 602.

In this example, the foam matrix 602 may be compressed into a compressed configuration in the manner described in any of the previously described examples. In addition, the foam matrix 602 may be allowed to expand to an operational configuration in the manner described in any of the previously described examples.

The media in each of the reservoirs $\mathbf{620}_{1,2}$ may include the same medium (or one or more media) or a different medium (or one or more media). For example, the first reservoir may include a powder that can be mixed with a liquid or gel coming from the connected reservoir, before contacting the foam matrix 602.

Figure 7:
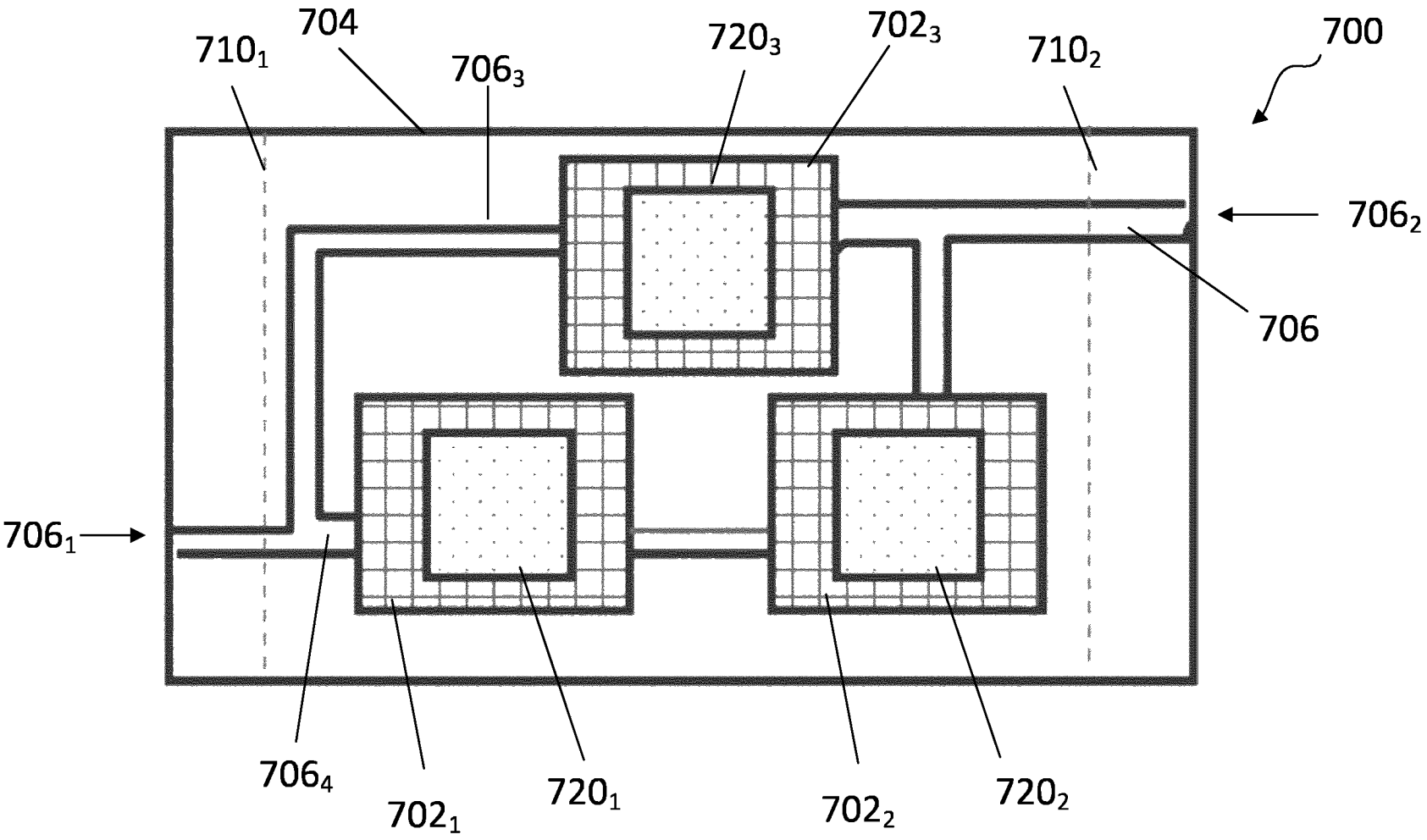
FIG. 7 illustrates a top cut-away view of another example of a consumable product.

FIG. 7 illustrates another example of a consumable product 700 for use in an aerosol generating device. The consumable product 700 has corresponding features to consumable product 300 (as noted by prefix 7-). In this example, the packaging element 704 of the consumable product 700 is configured to house two or more (in this example three) foam matrices $\mathbf{702}_{1,2,3}$. In the same manner as with previous examples, in a first configuration the packaging element 704 is configured to hold each of the foam matrices $\mathbf{702}_{1,2,3}$ in a compressed configuration. The consumable product 700 includes reservoirs $\mathbf{720}_{1,2,3}$ each adjacent to a corresponding foam matrix $\mathbf{702}_{1,2,3}$ (in the same manner as the reservoir of the consumable product 300).

In this example, the flow path 706 splits into sub-flow paths $\mathbf{706}_{3,4}$, with at least one of the foam matrices $\mathbf{702}_{1,2,3}$ housed within each of the sub-flow paths $\mathbf{706}_{3,4}$. In this example, the foam matrices $\mathbf{702}_{1,2,3}$ are 'vacuum packed' and subsequently sealed/unsealed in the same manner as described for previous examples.

Configuring a consumable product in this manner allows sequential heating of foam matrices, that is, one foam matrix being heated after another (for example foam matrix $\mathbf{702}_1$ may be heated before $\mathbf{702}_2$). In addition (but optional in other examples) configuring the flow path 706 to have sub-flow paths allows the concurrent heating of foam matrices (for example foam matrix $\mathbf{702}_1$ may be heated at the same time as foam matrix $\mathbf{702}_3$). These options allow the manufacturer to create a personalized consumable with a variety/combination of flavours and smoking parameters within each consumable product. For example, the (one or more) medium associated with each foam matrix may have a specific flavour or parameter.

Each foam matrix $\mathbf{702}_{1,2,3}$ may be provided with a corresponding medium/reservoir $\mathbf{720}_{1,2,3}$ in the manner described in any of the described examples.

Figure 8:
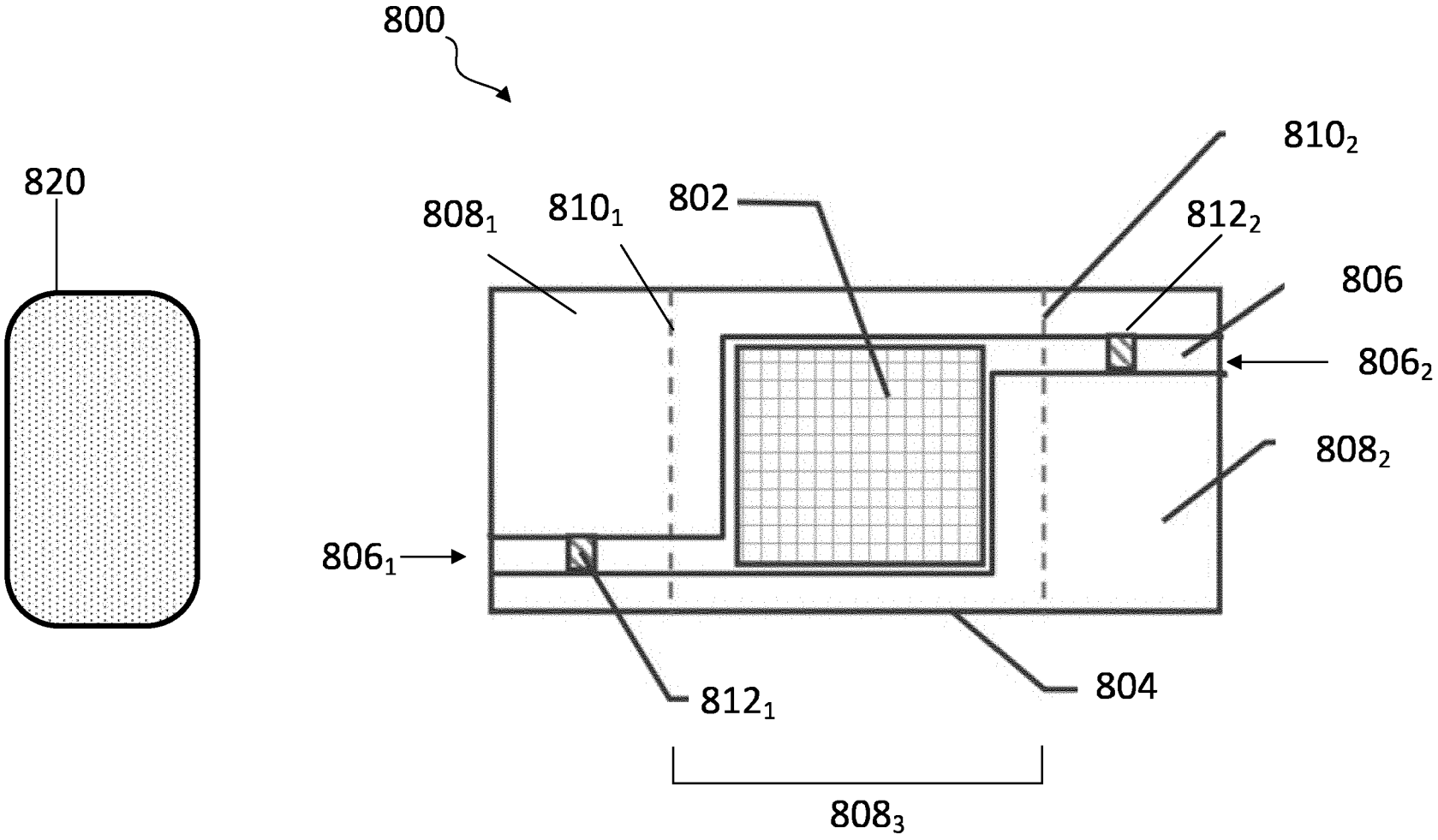
FIG. 8 illustrates a top cut-away view of another example of a consumable product.

FIG. 8 illustrates another example of a consumable product 800 for use in an aerosol generating device. The consumable product 800 includes a foam matrix 802 and a packaging element 804 housing the foam matrix 802. Similarly to previously described examples, in a first configuration the packaging element 804 holds the foam matrix 802 in a compressed configuration prior to use of the consumable product 800 in an aerosol generating device and in a second configuration the packaging element 804 allows the foam matrix 802 to expand from the compressed configuration prior to or during use of the consumable product in an aerosol generating device.

The foam matrix 802 is configured to couple to a reservoir of at least one medium for generating an aerosol within the foam matrix, in this example reservoir 820. In this example, the reservoir 820 is separate from the packaging element of the consumable product 800 prior to use. The foam matrix 802 is configured to couple to the reservoir 820 via the sacrificial seal defined by the seal $\mathbf{812}_1$.

In use, the packaging element 804 is brought to its second configuration to allow the foam matrix to expand to its operational configuration. In the second configuration, the packaging element 804 defines a path for flow 806 of at least one medium for generating an aerosol into the foam matrix 802 from the reservoir 820. When in the operational configuration, the foam matrix 802 is configured to at least partially draw the at least one medium from the reservoir 820 into the foam matrix 802. That is, releasing the compressed state of the foam matrix assists in ingestion of the aerosol generating medium from the reservoir. In other words, the reservoir 820 is in communication with the sacrificial seal (in other words via the inlet) such that upon breaking the seal $\mathbf{812}_1$ the contents of the reservoir 820 are drawn through the flow path 806 and into the foam matrix 802 by the pressure difference or as a result of capillary action.

Once the contents of the reservoir 820 are within the foam matrix 802, the consumable product 800 is inserted into an aerosol generating device and operated in the manner discussed for previous examples.

In some examples, the reservoir includes a port or opening, with at least one of the sacrificial seals (in other words the seals $\mathbf{812}_{1,2}$) being configured to fit/couple to the port or opening of the reservoir. In some examples, the consumable product includes means to pierce the reservoir, for example a protrusion located near the inlet 806$_1$, such that as the reservoir is brought adjacent to the inlet, the reservoir is pierced to couple the foam matrix 802 to the reservoir.

In alternative examples, the reservoir 820 may have means to break the sacrificial seal 812 of the consumable. This may be a protrusion, for example with a sharp end, preferably a pin or bolt.

In alternative examples, the reservoir 820 is housed within a consumable product, such that in use the consumable product containing the reservoir is brought into contact with the consumable product 800 to couple the reservoir 820 to the foam matrix 802.

Various modifications to the detailed arrangements as described above are possible. For example, the foam matrix may be held in the compressed configuration by the packaging element in any suitable way. For example, the packaging element may include a covering portion, for example an adhesive wrapping, configured to compress the packaging element against the foam matrix and thereby compress the foam matrix. That is, the foam matrix is mechanically compressed by the layers of the packaging element due to the covering portion. By mechanically compressing the layers of the packaging element, the at least one sacrificial seal (for example, between the layers of the packaging element, or a flow through passage between or within layers of the packaging element) is compressed into a closed configuration. The packaging element is configured such that at least one sacrificial seal is opened (and hence the foam matrix is released from the compressed configuration) upon removal of the covering portion of the packaging element from the consumable product.

In other words, the path for flow may be opened upon removal of the covering portion of the packaging element from the consumable product. That is, the packaging element may not necessarily be sealed to retain the foam matrix in the compressed configuration. Instead removal of the mechanical compression provided by the covering portion allows the foam matrix to expand.

The use of a covering portion to compress the foam matrix may be in addition to a compression force provided by a 'vacuum effect'.

The foam matrix may be released from the compressed configuration during use of the consumable product within an aerosol generating device. For example, the packaging element may be brought from the first to the second configuration by the aerosol generating device. For example, the locking of a lid component of an aerosol generating device, to fix the consumable product within the aerosol generating device, may open the sacrificial seal (for example, perforate a layer/open the flow path/break a seal), which triggers the expansion of the foam matrix from the compressed configuration. Alternatively, the expansion of the foam matrix may be triggered upon heating of the heating element within the aerosol generating device. Specifically, the heat provided by the heating element may melt the seal (where applicable) or may increase the pressure within the packaging element causing the foam matrix to expand. Such expansion of the foam matrix, while still constrained by the packaging element, may stress the seal leading to failure.

The reservoirs containing one or more media in the above described examples may be in addition to media impregnated within the corresponding foam matrix.

In the illustrated examples, the flow paths are generally configured to allow maximum contact time between the air flowing through the foam matrix (when drawn through by a user) and the foam matrix. However, the flow path may take any suitable path.

The flow path may not extend from one side of the packaging element to an opposing side of the packaging element. For example, the flow path may extend from one side of the body portion of the packaging element to the opposing side of the body portion of the packaging element. In this way, no separate seals are required, as the detachable portions acts to seal the inlet and outlet of the flow path. Removal of the detachable portions acts to open the flow path. That is, the detachable portions define the sacrificial seals.

The consumable products described above may be used with any suitable aerosol generating device. For example, the device may comprise an aperture or opening for the insertion into or removal (or both insertion into and removal) of the consumable product from a heating chamber thereof. The aperture or opening may be located at or adjacent the second end (where provided) of the device. The aperture or opening may be located upstream of the heating chamber. The aperture or opening may extend into or through the housing (or both into and through the housing) of the device (where provided). The aperture or opening may extend in a direction substantially parallel with the principal flow axis. Alternatively, the aperture or opening may extend in a direction substantially perpendicular to the principal flow axis. Alternatively, the aperture or opening may extend in a direction at an acute angle to the principal flow axis. The aperture or opening may be configured (for example, shaped or sized, or both shape and size) to allow passage therethrough of an article for forming an aerosol, for example such that said article is removable from or insertable (or both removable from and insertable) into the device. The aperture or opening may comprise one or more guide surface, for example configured to facilitate passage of an article for forming an aerosol through the aperture or opening. The guide surface or each guide surface may extend in a direction at an acute angle to the principal flow axis. The guide surface or each guide surface may be at least partially curved.

The aerosol generating device may be configured to heat the consumable in any suitable manner. The aerosol generating device may be configured to heat the consumable by irradiation with electromagnetic radiation. The electromagnetic radiation may comprise infrared radiation, for example heating. The aerosol generating device may be configured to heat the consumable product using inductance heating. Such devices may include a susceptor—a conductive resistive material in which Eddy currents will be generated to provide Joule heating when the susceptor is located inside an alternating magnetic field. Typically, the magnetic field is provided by the aerosol generating device.

The consumable product itself may include a heating element. That is, the aerosol generating device may comprise an induction heater arranged to inductively heat a heating element (in other words a susceptor) of the consumable product within the heating chamber. The induction heater may comprise one or more induction coils located adjacent the consumable product. In use, the susceptor of the consumable product may be inductively heated by the induction coil or each induction coil. The susceptor then, in turn, conductively, convectively or radiatively (or any combination of conductively, convectively or radiatively) heats the aerosol-forming medium thereabout it.

The heating element of the consumable product may be located in between the layers of the packaging element.

Alternatively, the heating element may be located within the foam matrix (for example a layer of conductive and resistive material around the periphery or in the centre of the foam matrix). In examples where the heating element is included within the consumable product, the heating element may include cavities to allow gel/liquid to pass therethrough or be drawn therethrough by capillary action. Alternatively, the foam matrix itself may act as a heating element. That is, the foam may include an electrically conductive and resistive structure (for example metallic).

The heating element of the aerosol generating device or consumable product may be configured or configurable to heat the medium for forming an aerosol to a temperature less than 400 degrees centigrade, for example less than 300 degrees centigrade, say less than 270 degrees centigrade. In embodiments, the heating element may be configured or configurable to heat an article for forming an aerosol received in the heating chamber to a temperature less than 250, 225, 200, 175 or 150 degrees centigrade, for example less than 140, 130, 120, 110, 100 or 90 degrees centigrade.

In some embodiments, the aerosol generating device may comprise a power source, for example a source of electrical power. The power source may be operably connected or connectable to the heating element (where provided). The power source may comprise a battery or a capacitor or a super capacitor, or any combination of battery, capacitor or super capacitor. In embodiments, the power source may comprise a reservoir of fuel which may be activatable, in use, to heat the heater. The reservoir of fuel may comprise a fluid or solid fuel. Where the fuel is in fluid form the fuel may be deliverable to the heating element, in use. For example, the reservoir of fuel may be operably in fluid communication with the heating element.

The consumable product may have any suitable shape or size. For example, the consumable product may have a cuboidal shape to fit the heating chamber of a corresponding aerosol generating device. The consumable product may have a length of between approximately 30 millimetres (mm) and approximately 100 millimetres, say approximately 45 millimetres. In embodiments, the consumable product may have a length of between approximately 70 millimetres and 120 millimetres.

The consumable product may have a width of at least 5 mm, for example a width of between approximately 5 millimetres and approximately 12 millimetres, say of between approximately 5 millimetres and approximately 10 millimetres or of between approximately 6 millimetres and approximately 8 millimetres. In an embodiment, the consumable product may have an external width of 7.2 millimetres+/−10 percent (%).

The resistance to draw (RTD) of the device for generating an aerosol with an article for forming an aerosol received in the heating chamber may be between approximately 80 millimetres of water gauge (mmWG) and approximately 140 millimetres of water gauge (mmWG). As used herein, resistance to draw is expressed with the units of pressure 'mmWG' or 'millimetres of water gauge' and is measured in accordance with ISO 6565:2002.

It will be appreciated that preferred features described above in relation to one aspect of the invention may also be applicable to other aspects of the invention.

In above described examples, keeping the foam compressed until use ensures the consumable product is compact. In addition, oxidation of any medium for generating an aerosol within the foam matrix or reaction of several media within the foam matrix is reduced prior to use and hence the lifespan of such consumable products is lengthened.

In above described examples, by separating the medium from the foam matrix with a sacrificial seal reduces oxidation of the medium in the foam matrix prior to use. Hence the lifespan of such consumable products is lengthened.

In above described examples, by separating adjacent reservoirs by a sacrificial seal reduces reaction between the media prior to use. Hence the lifespan of such consumable products is lengthened.

The invention claimed is:

1. A consumable product for use in an aerosol generating device, the consumable product comprising:

a foam matrix, wherein the foam matrix is impregnated with a medium for generating an aerosol and, a packaging element housing the foam matrix;

wherein the packaging element is configured to hold the foam matrix in a first, compressed, configuration prior to use of the consumable product in an aerosol generating device;

the packaging element having a first sacrificial seal, wherein upon opening the first sacrificial seal, the packaging element holds the foam matrix in a second, less compressed, configuration, wherein the foam matrix in at least the second, less compressed, configuration enables fluid to pass through it.

2. A consumable product as claimed in claim 1, wherein the packaging element has a second sacrificial seal.

3. A consumable product as claimed in claim 2, wherein the first and second sacrificial seals are in fluid communication.

4. A consumable product as claimed in claim 1, wherein in the first, compressed, configuration the foam matrix is partially vacuumed within the packaging element.

5. A consumable product as claimed in claim 1, wherein at least the first sacrificial seal is in communication with a reservoir of aerosol generating medium.

6. A consumable product as claimed in claim 5, wherein at least the first sacrificial seal is configured to fit a corresponding port or opening of the reservoir of an aerosol generating medium.

7. A consumable product as claimed in claim 6, wherein the reservoir of aerosol generating medium is separate from the packaging element of the consumable prior to use.

8. A consumable product as claimed in claim 5, wherein the reservoir of aerosol generating medium is housed within the packaging element.

9. A method of filling an aerosol generating consumable for use in an aerosol generating device comprising, compressing and packaging a foam matrix wherein the packaging element has at least one sacrificial seal;

coupling the at least one sacrificial seal to a reservoir of aerosol generating medium; and releasing the compressed state of the foam matrix such that this assists in ingestion of the aerosol generating medium from the reservoir by opening the at least one sacrificial seal, and wherein upon opening the at least one sacrificial seal the packaging element holds the foam mixture in a second, less compressed, configuration.

10. A method of filling an aerosol generating consumable as claimed in claim 9, wherein compressing the foam matrix comprises partial vacuum compressing.

11. A method of manufacturing an aerosol generating consumable product for use in an aerosol generating device, the method comprising:

providing a foam matrix, wherein the foam matrix is impregnated with a medium for generating an aerosol, and a packaging element;

housing the foam matrix in a first, compressed, configuration within the packaging element;

the packaging element having a first sacrificial seal, wherein upon opening the first sacrificial seal the packaging element holds the foam matrix in a second, less compressed, configuration, wherein the foam matrix in at least the second, less compressed, configuration enables fluid to pass through it.

12. An aerosol generating device for use in generating an aerosol comprising a consumable product as claimed in claim 1.

13. An aerosol generating device as claimed in claim 12, wherein the consumable is subjected to heat in use.

14. An aerosol generating device for use in generating an aerosol comprising a consumable product as claimed in claim 2.

15. An aerosol generating device as claimed in claim 14, wherein the consumable is subjected to heat in use.

16. An aerosol generating device as claimed in claim 15, wherein the at least two sacrificial seals allow fluid communication to a mouthpiece end of the aerosol generating device.

* * * * *